US006243885B1

(12) United States Patent
Lopez-Torres, Jr.

(10) Patent No.: US 6,243,885 B1
(45) Date of Patent: Jun. 12, 2001

(54) FLUSH VALVE MOUNTED BEVERAGE HOLDER AND ASSOCIATED METHOD

(75) Inventor: Augusto Lopez-Torres, Jr., Orlando, FL (US)

(73) Assignee: Gooseneck Enterprises LLC, Orlando, FL (US)

( * ) Notice: Subject to any disclaimer, the term of this patent is extended or adjusted under 35 U.S.C. 154(b) by 0 days.

(21) Appl. No.: 09/373,512

(22) Filed: Aug. 12, 1999

(51) Int. Cl.[7] ..... E03D 1/00
(52) U.S. Cl. ..... 4/300; 220/737
(58) Field of Search ..... 4/300, 301; 220/737

(56) References Cited

U.S. PATENT DOCUMENTS

| | | | | |
|---|---|---|---|---|
| 1,957,353 | | 5/1934 | Piersall . | |
| 3,799,037 | * | 3/1974 | Schmidt | 92/98 R |
| 3,850,398 | | 11/1974 | Kantor . | |
| 4,215,445 | * | 8/1980 | Antos et al. | 4/323 |
| 4,683,598 | * | 8/1987 | Jones | 4/301 |
| 5,169,108 | | 12/1992 | Carlson . | |
| 5,356,107 | | 10/1994 | Sinohuiz . | |
| 5,695,162 | | 12/1997 | DiCastro . | |
| 6,006,371 | * | 12/1999 | Korte | 4/391 |

* cited by examiner

*Primary Examiner*—Joseph M. Moy
(74) *Attorney, Agent, or Firm*—Allen, Dyer, Doppelt, Milbrath & Gilchrist, P.A.

(57) ABSTRACT

An apparatus and method for a flush valve mounted holder having a closed bottom and an open top, the closed bottom configured to replace the cover of a flush valve having a flush valve cover in a commercial sanitary fixture such as a urinal or toilet, the holder comprising a base positioned to form the closed bottom of the holder, the base having threads positioned thereon for connecting to the flush valve, to thereby mount the holder on the flush valve in place of the flush valve cover, and a body connected to the base and positioned to form the open top of the flush valve mounted holder, the body having a shape suitable for holding at least one item for a person. The holder is preferably configured so that the body includes an outer wall extending vertically upwardly from the base to form a hollow cylinder including an inner cavity having a floor and a mouth opening having a mouth rim, the hollow cylinder, mouth opening and inner cavity being suitably dimensioned for receiving a beverage container therein, to thereby define a beverage container holder. The invention also encompasses a method of advertising including the step of connecting an advertisement to a flush valve assembly of a commercial sanitary fixture such as a urinal or toilet by replacing an original part of the flush valve assembly with a functionally equivalent part bearing said advertisement.

26 Claims, 6 Drawing Sheets

20
42
44
46
47
30

FLUSH VALVE MOUNTED BEVERAGE HOLDER AND ASSOCIATED METHOD

FIELD OF THE INVENTION

The present invention relates to the field of holders for beverage containers and, more particularly, to a beverage container holder configured for mounting on a flush valve such as found on commercial urinals and toilets.

BACKGROUND OF THE INVENTION

Commercial sanitary fixtures such as urinals and toilets are in widespread use. These fixtures are installed in buildings and facilities where large groups of people congregate for sporting events, concerts, conferences, and other gatherings. In addition, these fixtures are also commonly found in eating and drinking establishments such as restaurants, bars and nightclubs.

The public attending crowded events such as football games, or visiting a concert facility or nightclub, will eventually visit the restroom where these fixtures are installed. Often, a person will be carrying a drink container of some kind, a cup, bottle or glass, for which the person will need to find a safe resting place while the person uses the toilet or urinal. Commonly, the person may try to balance the beverage container upon the edge of the sanitary fixture or on the associated plumbing, often resulting in a spilled drink, or broken bottle, and liquid and glass covering the floor of the restroom. Such a spill creates a highly unsafe condition for all patrons, and frustration for the patron who accidentally spills his/her beverage in that manner.

SUMMARY OF THE INVENTION

With the foregoing in mind, the present intention advantageously provides a beverage container holder connected to the flush valve housing of a sanitary fixture such as a urinal or toilet. The flush valve mounted holder has a closed bottom and an open top, the closed bottom being configured to replace the original cover of the flush valve in a commercial sanitary fixture such as a urinal or toilet. The flush mounted holder includes a base positioned to form the closed bottom of the holder, the base having threads for connecting to the flush valve housing, to thereby mount the holder on the flush valve in place of the original flush valve cover. The holder also includes a body connected to the base and positioned to form the open top of the flush valve mounted holder, the open top having a shape suitable for holding at least one item for a person using the sanitary fixture. The open top may be shaped as a shelf, as an ashtray, and as a holder for beverage containers.

The holder may preferably further include a body having an outer wall extending vertically upwardly from the base to form a hollow receptacle including an inner cavity having a floor and a mouth opening having a mouth rim. The hollow receptacle, mouth opening and inner cavity are suitably dimensioned for receiving a beverage container therein, to preferably define a beverage container holder. In a preferred embodiment the holder may further include a hexagonally shaped element positioned to receive a wrench for aiding in connecting and disconnecting the holder relative to the flush valve housing.

Additionally, the present invention includes associated methods for advertising, including the step of connecting an advertisement to a flush valve assembly of a commercial sanitary fixture such as a urinal or toilet by replacing an original part of the flush valve assembly with a functionally equivalent part bearing the advertisement. The method preferably further includes the step of providing the functionally equivalent part in a predetermined color, to thereby promote a sports team or other entity associated with the color. Also, the method may preferably include the advertisement designed as a predetermined logo, to thereby promote a specified entity such as a university or sports team.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. FIGS. 1 through 13 illustrate various embodiments of the present invention, which will be further described below.

Figure 1:
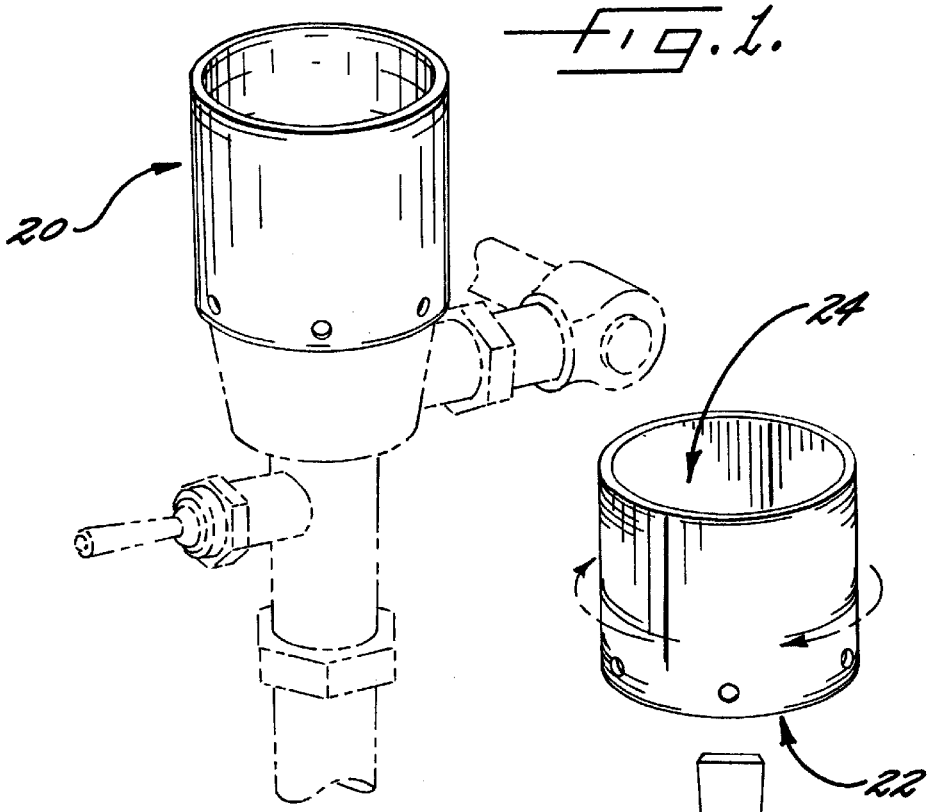
FIG. 1 is a perspective view of the flush valve mounted holder according to an embodiment of the present invention.
Figure 2:
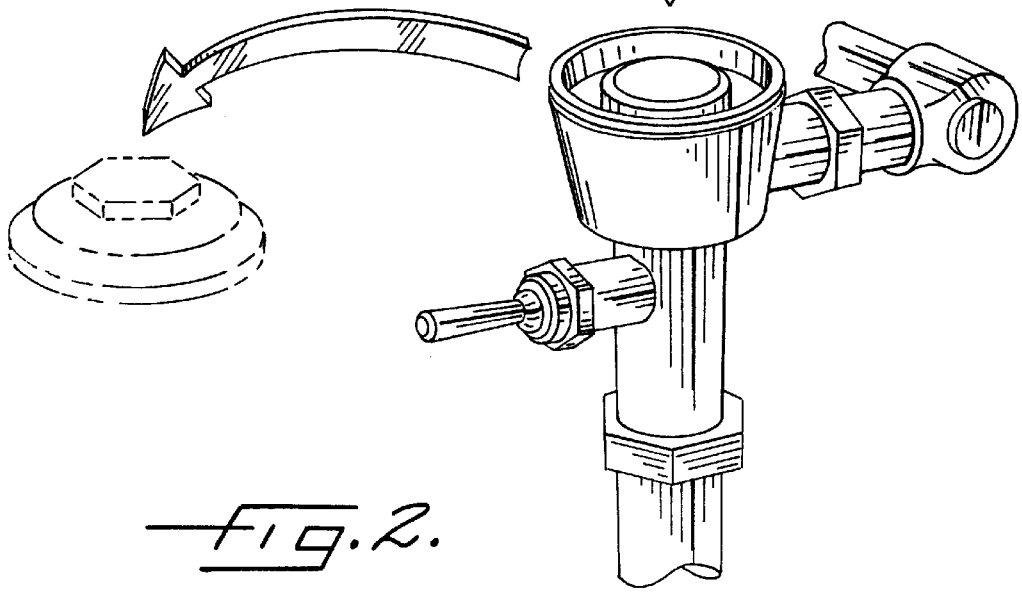
FIG. 2 shows a sequential view illustrating connecting the holder to the flush valve housing.

FIG. 1 illustrates the flush valve mounted holder 20 in place connected to the flush valve housing of a commercial sanitary fixture. FIG. 2 depicts the process for connecting the flush valve mounted holder 20. The holder 20 has a closed bottom 22 and an open top 24. As illustrated in FIG.

Figure 10:
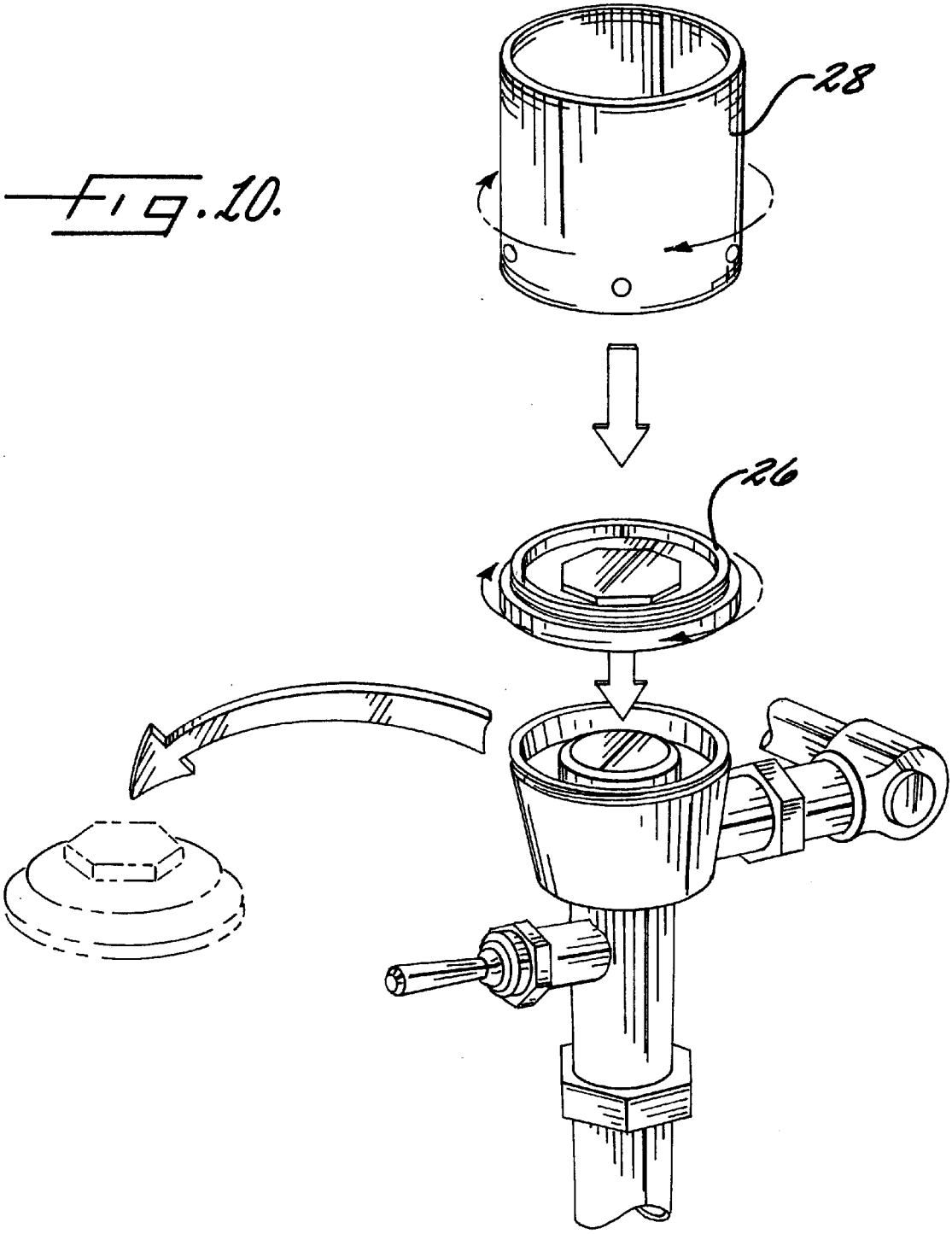
FIG. 10 shows an alternate embodiment of the invention.
Figure 12:
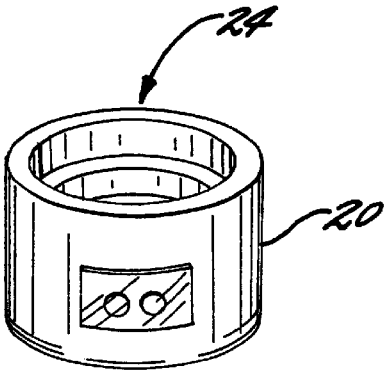
FIG. 12 is a side elevation showing interior detail of the container for use with an automatic flush sensor unit.
Figure 12:
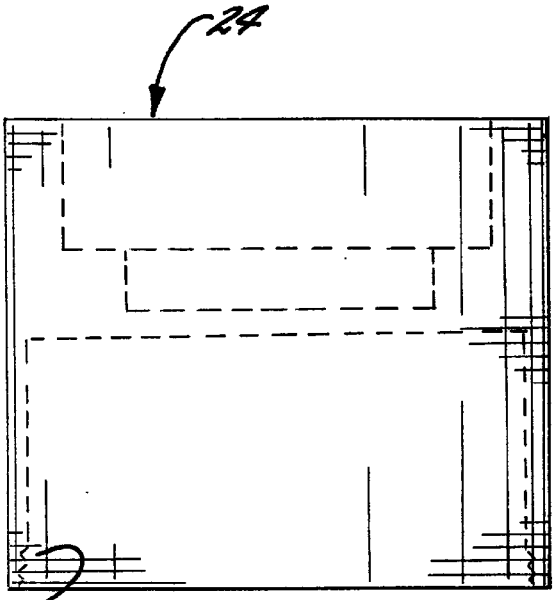
Figure 14:
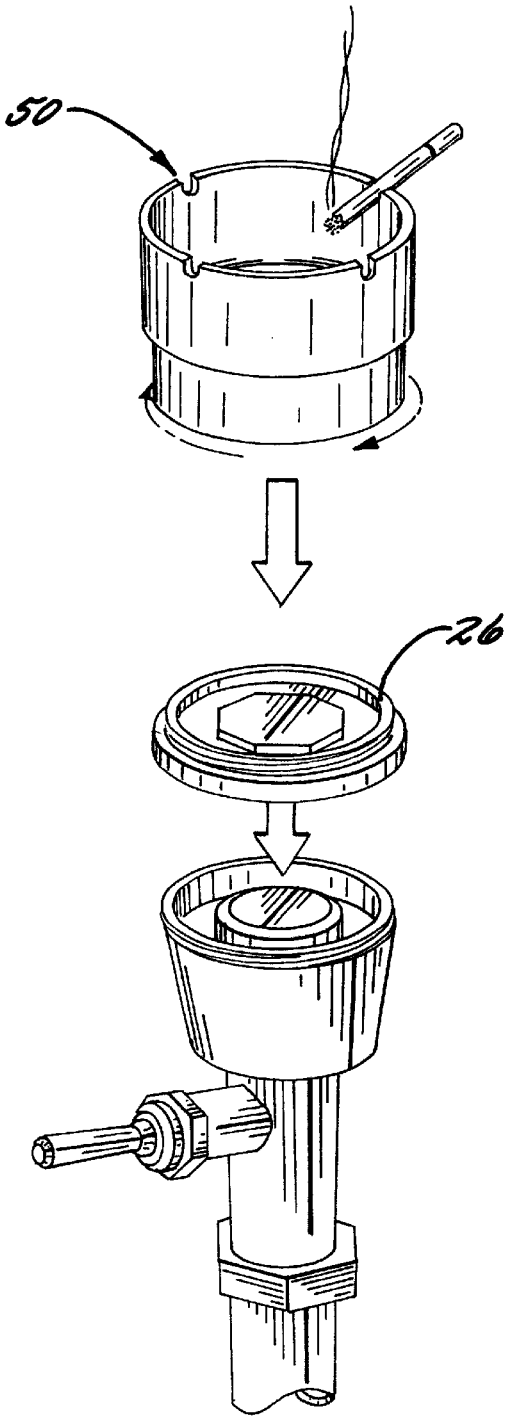
FIG. 14 illustrates an ashtray embodiment of the invention.
Figure 15:
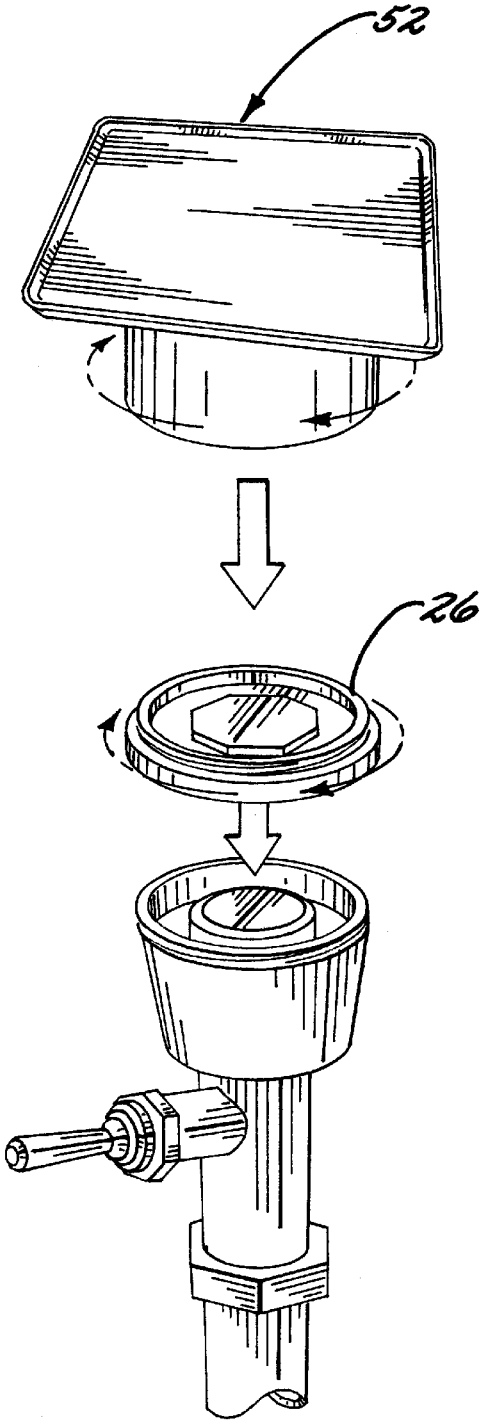
FIG. 15 is a shelf embodiment of the invention.

2, the closed bottom 22 is configured to replace the cover of a flush valve housing in a commercial sanitary fixture such as a urinal or toilet. The holder 20 includes a base 26 and a body 28, which may be separate and connectable pieces, as shown in FIG. 10, but are preferably one integral part, as seen in FIGS. 1 and 2. The base 26 is positioned to form the closed bottom of the holder 20, having threads 48 positioned on the periphery thereof for connecting to said flush valve, to thereby mount the holder 20 on the flush valve housing in place of the flush valve cover, as best seen in FIGS. 2, 10 and 12. The body 28 is connected to the base 26 and extends to form the open top 24 of the holder 20, the body 28 having a shape suitable for holding at least one item for a person using the sanitary fixture. In a preferred embodiment, the open top 24 may be shaped as a shelf 52, as shown in FIG. 15, for holding at least one item for a person using the sanitary fixture. Additionally, the open top may be shaped as an ashtray 50, illustrated in FIG. 14, for holding cigarettes, cigars and the like.

Figure 5:
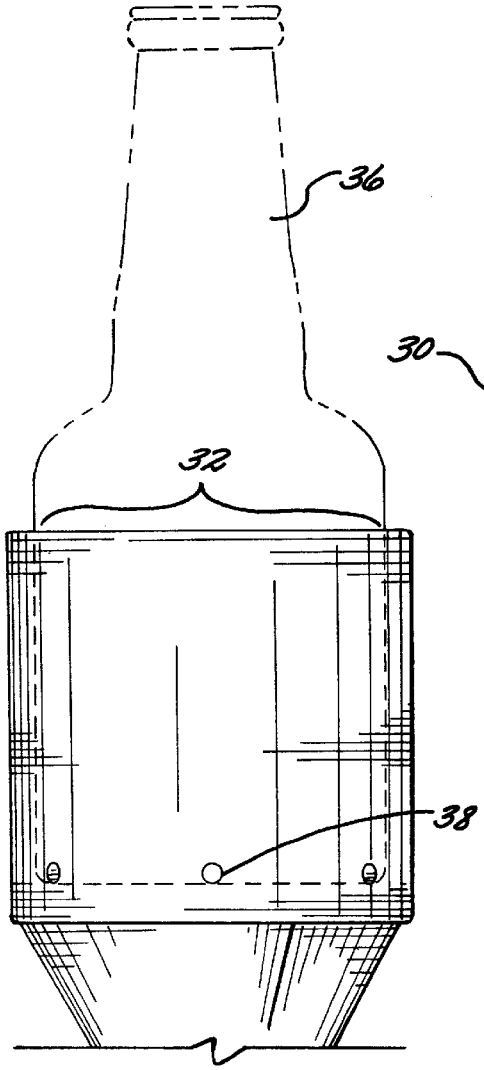
FIG. 5 is a side elevation showing the holder with a bottle therein.
Figure 4:
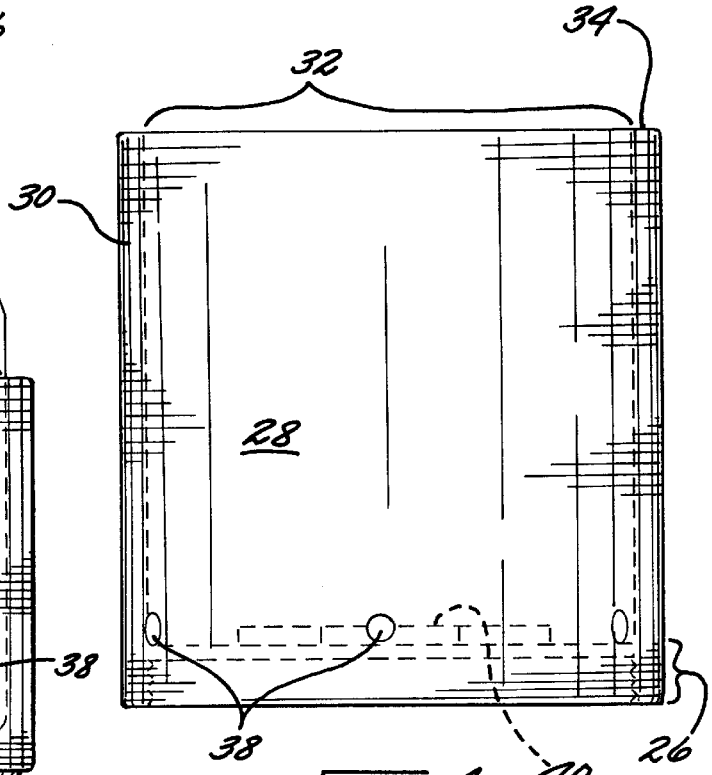
FIG. 4 is a side elevation showing drain openings and depicting a recessed hexagonal socket in the floor of the inner cavity.

In another preferred embodiment of the invention, as seen in FIG. 4, the holder 20 has a body 28 which further includes an outer wall 30 extending vertically upwardly from the base 26 to form a hollow cylinder including an inner cavity having a floor and a mouth opening having a mouth rim 34. As shown in FIGS. 4 and 5, the hollow cylinder, mouth opening 32 and inner cavity are suitably dimensioned for receiving a beverage container 36 therein, thereby defining a beverage container holder 20. In addition, as best shown in FIG. 4, the holder 20 has an outer wall 30 which may further include therethrough a plurality of openings 38 positioned near the floor of the inner cavity to provide fluid outlets from the cavity to the outside, to thereby substantially drain liquid that might accumulate within the holder 20.

Figure 3:
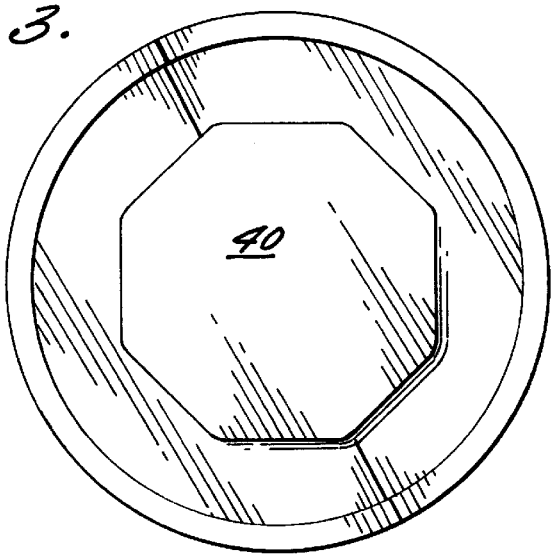
FIG. 3 is a top plan view of the inner cavity of the beverage container holder in one embodiment of the invention.

As shown in FIGS. 3 and 4, in another preferred embodiment the holder 20 further includes a hexagonally shaped element 40 positioned to receive a wrench for aiding in connecting and disconnecting the holder 20 relative to the flush valve housing. The hexagonally shaped element 40 may be positioned on the floor of the inner cavity, as seen in FIGS. 3 and 4. In one embodiment, as seen in FIG. 3, the hexagonally shaped element 40 extends downwardly below the floor of the inner cavity, so as to form a depression shaped as a hexagonal socket on the floor of the inner cavity, to therein receive a socket wrench for aiding in connecting and disconnecting the holder 20 relative to the flush valve. In another preferred embodiment, seen in FIG. 4, the hexagonally shaped element 40 is positioned on the base 26 and extends upwardly above the floor of the inner cavity, so as to form a raised hexagonal nut on the floor of the inner cavity, to thereon receive a wrench for connecting and disconnecting the holder 20. The hexagonal element may additionally be placed around the exterior periphery of the base to receive a wrench thereon.

Figures 6, 7, 8, 9:
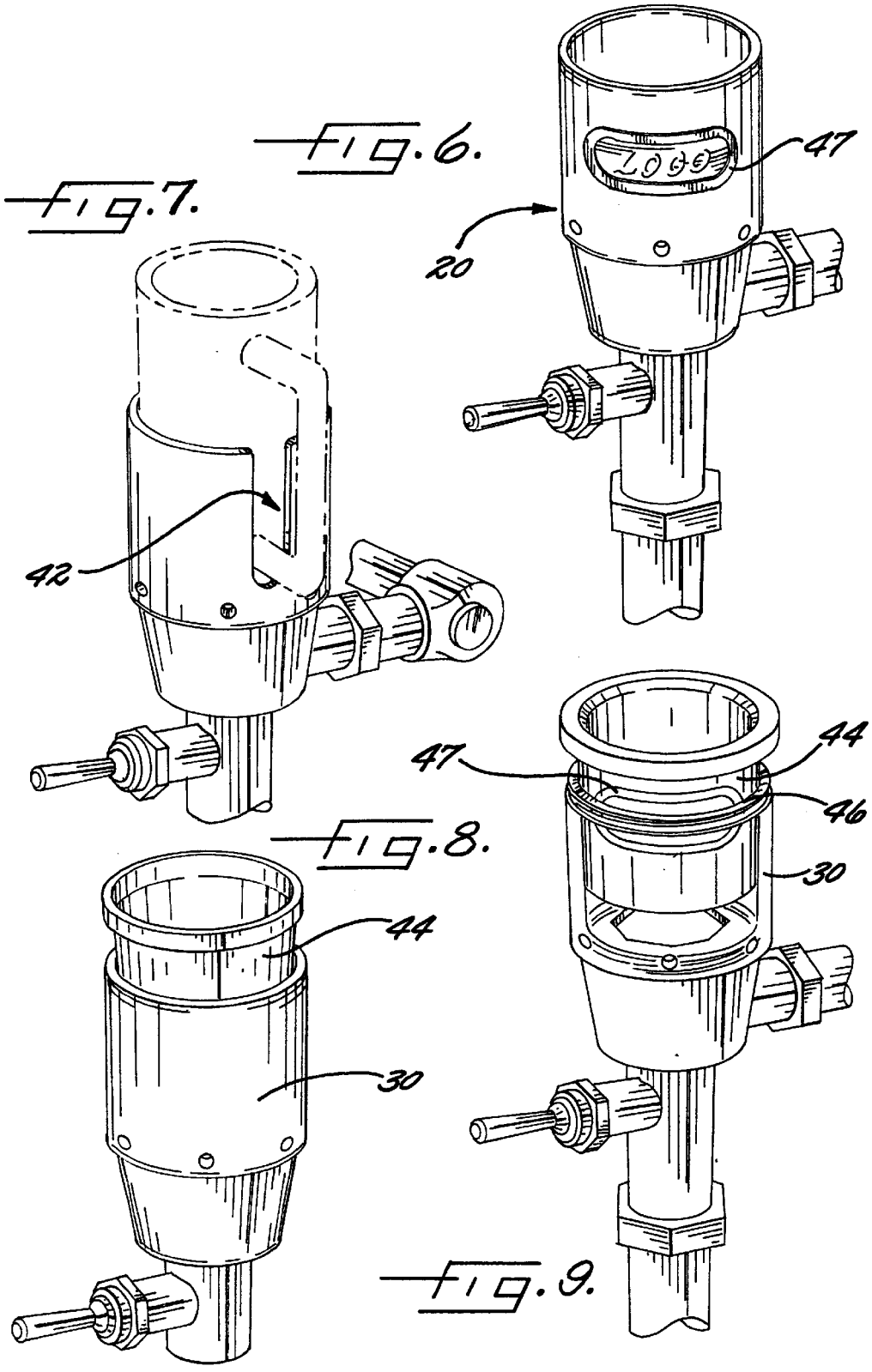
FIG. 6 illustrates a method of advertising by placement of a logo on the holder.
FIG. 7 shows an embodiment including an opening to accommodate a container having a handle.
FIG. 8 is a side perspective view of an embodiment of a double-walled container having an inner wall.
FIG. 9 illustrates a double-walled container wherein an advertisement is positioned between the walls and the outer wall is transparent, to thereby allow the advertisement to be visible.

In yet another preferred embodiment, the holder 20 provides for accepting a container having a handle, as shown in FIG. 7. In this embodiment, the outer wall 30 of the body 28 further includes an elongated slot 42 positioned on the mouth rim 34 and extending downwardly along the outer wall 30 from the mouth rim 34 toward the base 26 and being suitably dimensioned for allowing the holder 20 to receive within the inner cavity a beverage container 36 having a handle, the handle positioned within said elongated slot 42.

The holder 20 may embody a double-walled beverage holder, as best shown in FIGS. 8 and 9. In this preferred embodiment, the double-walled holder further includes an inner wall 44 positioned within the inner cavity in substantial juxtaposition with the outer wall 30 so as to define a void space between the outer and inner walls, thereby providing a double-walled beverage container holder 46. As also seen in FIG. 9, the outer wall 30 of the holder 20 may include or be made of a substantially transparent material, so that an advertisement 47 may be positioned within the void space between the inner wall 44 and outer wall 30, to be visible through the substantially transparent material and thereby provide an advertising platform connected to the commercial sanitary fixture. The holder may be configured to provide for a removable inner wall 44 wherein the outer wall 30 includes threads 48 and the inner wall 44 further includes complementary threads for removably connecting the inner wall 44 with the outer wall 30, to thereby allow for removing the inner wall 44 from the double-walled beverage container holder 46. In this embodiment, the outer wall 30 may also further include a substantially transparent material and an advertisement 47 may be removably positioned within the void space between the inner 44 and outer 30 walls so as to be visible through the substantially transparent material, thereby providing a changeable advertising platform connected to the commercial sanitary fixture. Advertising may be affixed to any of the embodiments of the present invention, for example, by positioning the advertisement 47 on a surface of the beverage holder, as shown in FIG. 6.

Figure 13:
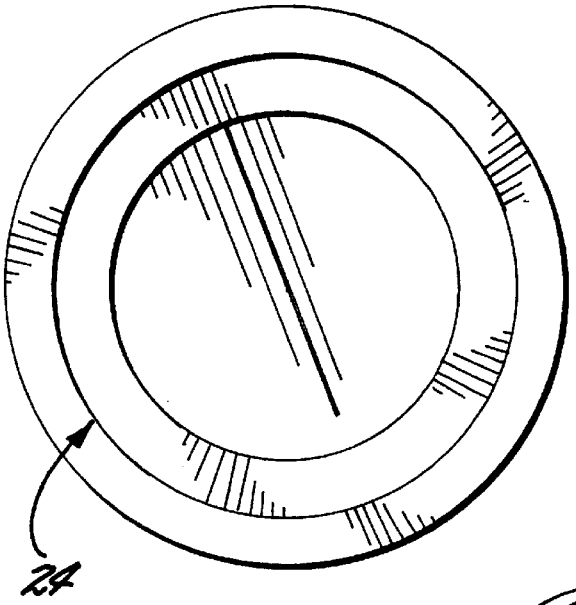
FIG. 13 shows a top plan view of the container for use with an automatic flush sensor unit.
Figure 11:
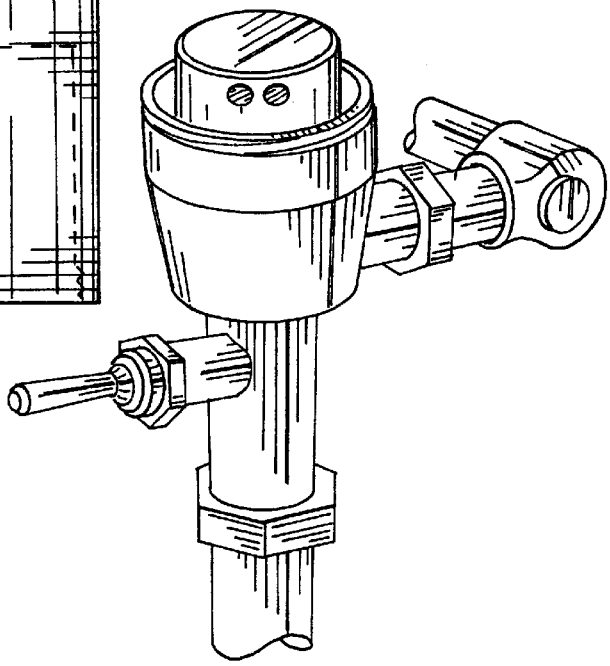
FIG. 11 illustrates an embodiment for using with automatic flush sensor unit.

As shown in FIGS. 11 through 13, the present invention may be preferably configured to provide a flush valve housing mounted holder for replacing the cover of an automatic flush valve. Such automatic flush valves are usually activated by an optical sensor positioned inside the flush valve cover, as shown in FIG. 11. The flush valve cover is made of a material suitable for the sensor to obtain sensing information through it. As seen in FIG. 12, this embodiment of the invention also includes outer wall threads 48 complementary to threads found on the flush valve. As also seen in FIGS. 12 and 13, the open top 24 of the holder may be configured having stepped sides to accept containers which may vary in diameter. Those skilled in the art will appreciate that such a top having stepped sides may be also employed with any of the other embodiments of the present invention.

In addition, as illustrated in FIGS. 1 through 13, the present invention includes a method of mounting a holder 20 on a flush valve of a commercial sanitary fixture such as a urinal or toilet having a flush valve cover. The method includes the step of providing a holder 20 having a closed bottom 22 and an open top 24, the closed bottom 22 configured to replace the cover of the flush valve, the holder 20 including a base 26 positioned to form the closed bottom 22 of the holder, the base 26 having threads 48 positioned thereon for connecting to the flush valve, and a body 28 connected to the base 26 and positioned to form the open top 24 of the flush valve mounted holder 20, the body 28 having a shape suitable for holding at least one item for a person, and the step of connecting the holder 20 to the flush valve by using the threads 48 to thereby mount the holder 20 on the flush valve in place of the flush valve cover.

Additionally, as shown in FIGS. 6 and 9, the present invention includes a method of advertising which includes the step of connecting an advertisement 47 to the flush valve housing of a commercial sanitary fixture such as a urinal or toilet by replacing an original part of the flush valve assembly with a functionally equivalent part bearing the advertisement 47. In the present invention, the base 26 of the holder 20 is the functional replacement for the flush valve cover. This functional replacement provides the added benefit of serving as a holder 20 for a beverage container 36. The method may further include the step of providing the functionally equivalent part in a predetermined color, to thereby promote a sports team or entity associated with that color. Also, the method may further provide for including a predetermined logo in the advertisement 47, to thereby promote a specified entity such as a university or sports team associated with the logo.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A holder connected to a flush valve housing in a commercial sanitary fixture said holder comprising:

a) a base forming a closed bottom of the holder, the base having threads connecting to complementary threads positioned on said flush valve housing; and b) a body positioned on said base to form an open top of the holder, the body shaped for holding at least one item.

2. The holder of claim 1, further including a base and a body fabricated as one integral part.

3. The holder of claim 1, wherein the body further includes an outer wall extending vertically upwardly from the base to form a hollow cylinder including an inner cavity having a floor and a mouth opening having a mouth rim, said hollow cylinder, mouth opening and inner cavity being suitably dimensioned for receiving a beverage container therein, to thereby define a beverage container holder.

4. The beverage container holder of claim 3, wherein the outer wall further includes therethrough a plurality of openings positioned near the floor to provide fluid outlets from the cylinder cavity to the outside, to thereby substantially drain liquid accumulating within the cylinder cavity.

5. The holder of claim 1, further including a hexagonally shaped element positioned to receive a wrench for aiding in connecting and disconnecting the holder relative to the flush valve housing.

6. The holder of claim 1, wherein the open top forms a shelf positioned to hold at least one item for a user of the sanitary fixture.

7. The holder of claim 1, wherein the open top forms an ashtray for holding cigarettes, cigars and the like for a user of the sanitary fixture.

8. The beverage container holder of claim 3, wherein the outer wall further includes an elongated slot positioned on the mouth rim, the elongated slot extending downwardly along the outer wall from the mouth rim toward the base and being suitably dimensioned for allowing the holder to receive within the inner cavity a beverage container having a handle, the handle positioned within said elongated slot.

9. The beverage container holder of claim 3, wherein said hollow cylinder further includes an inner wall positioned within the inner cavity in substantial juxtaposition with said outer wall so as to define a void space between the outer and inner walls, to thereby provide a double-walled beverage container holder.

10. The beverage container holder of claim 9, wherein said outer wall further comprises a substantially transparent material and wherein an advertisement is positioned within said void space so as to be visible through the substantially transparent material, to thereby provide an advertising platform connected to a commercial sanitary fixture.

11. The beverage container holder of claim 9, wherein the outer wall further includes threads and the inner wall further includes complementary threads for removably connecting the inner wall with the outer wall, to thereby allow for removing the inner wall from the double-walled beverage container holder.

12. The beverage container holder of claim 11, wherein said outer wall further comprises a substantially transparent material and wherein an advertisement is removably positioned within said void space so as to be visible through the substantially transparent material, to thereby provide a changeable advertising platform connected to a commercial sanitary fixture.

13. The holder of claim 1, further including an advertisement positioned on said holder, to thereby provide an advertising platform connected to a commercial sanitary fixture.

14. A flush valve for a commercial sanitary fixture wherein said flush valve includes a housing having a holder for at least one article, said holder comprising:

a) a holder base extending from a first portion of said housing, said first portion having threads connected to complementary threads on a second portion of said housing; and b) a holder body positioned on said holder base and extending generally upwardly therefrom, said holder body shaped for holding at least one item.

15. The flush valve of claim 14, wherein said holder base and said holder body are fabricated as one integral part.

16. The flush valve of claim 14, wherein said holder body further includes an outer wall extending upwardly from the holder base to form a cylinder including an inner cavity having a floor and a mouth opening having a mouth rim, said cylinder, mouth opening and inner cavity suitably dimensioned for holding a beverage container therein, to thereby define a beverage container holder.

17. The flush valve of claim 16, wherein said outer wall further includes therethrough a plurality of openings positioned near said floor to provide outlets from the inner cavity to the outside, to thereby substantially drain liquid accumulating within the inner cavity.

18. The flush valve of claim 14, further comprising a member for thereon connecting a wrench for aiding connecting and disconnecting the flush valve to the sanitary fixture.

19. The flush valve of claim 14, wherein the holder body further comprises a shelf for holding at least one item.

20. The flush valve of claim 14, wherein the holder body forms an ashtray for holding cigarettes, cigars and the like.

21. The flush valve of claim 16, wherein the outer wall further includes an elongated slot extending downwardly along the outer wall from the mouth rim toward the base, said elongated slot suitably dimensioned for allowing the holder to receive within the inner cavity a beverage container having a handle, the handle positioned within said elongated slot.

22. The flush valve of claim 16, wherein said cylinder further includes an inner wall positioned within the inner cavity, spaced-apart and connected to said outer wall thereby defining a void space therebetween so as to provide a double-walled beverage container holder.

23. The flush valve of claim 22, wherein said outerwall further comprises a substantially transparent material and wherein an advertisement is positioned within said void space so as to be visible through the substantially transparent material, to thereby provide an advertising platform connected to a commercial sanitary fixture.

24. The flush valve of claim 22, wherein the outer wall further includes a first set of threads and the inner wall further includes a second set of threads complementary to said first set of threads for removably connecting the inner wall with the outer wall.

25. The flush valve of claim 24, further comprising an advertisement removably positioned within said void space so as to be visible through said outer wall.

26. The flush valve of claim 14, further comprising an advertisement positioned on said holder body so as to be visible to a user of said sanitary fixture.

* * * * *